US010508464B2

(12) United States Patent
Mägi et al.

(10) Patent No.: US 10,508,464 B2
(45) Date of Patent: Dec. 17, 2019

(54) STRUCTURE OF A FACILITY FOR DEMINING, INVESTIGATING AND TESTING OF AN EXPLOSIVE DEVICE

(71) Applicant: Amhold AS, Tallinn (EE)

(72) Inventors: Arvu Mägi, Tallinn (EE); Olavi Ottas, Tallinn (EE)

(73) Assignee: Amhold AS, Tallinn (EE)

( * ) Notice: Subject to any disclaimer, the term of this patent is extended or adjusted under 35 U.S.C. 154(b) by 99 days.

(21) Appl. No.: 15/391,936

(22) Filed: Dec. 28, 2016

(65) Prior Publication Data

US 2017/0191283 A1 Jul. 6, 2017

(30) Foreign Application Priority Data

Dec. 31, 2015 (EE) ..... 201500087 U

(51) Int. Cl.

| | |
|---|---|
| ***E04H 9/10*** | (2006.01) |
| ***F42D 5/045*** | (2006.01) |
| ***F42B 35/00*** | (2006.01) |
| *E04B 1/98* | (2006.01) |

(52) U.S. Cl.

CPC ..... *E04H 9/10* (2013.01); *F42B 35/00* (2013.01); *F42D 5/045* (2013.01); *E04B 1/98* (2013.01)

(58) Field of Classification Search

CPC ... F24B 35/00; E05G 1/00; E05G 1/02; E05G 1/024; E05G 1/06; E04H 9/00; E04H 9/021; E04H 9/04; E04H 9/06; E04H 9/08; E04H 9/10; E04H 9/12; F24D 5/045; F24D 5/04

USPC ..... 52/79.1, 79.4, 79.7, 79.8, 79.9; 109/1 S

See application file for complete search history.

(56) References Cited

U.S. PATENT DOCUMENTS

| | | | | |
|---|---|---|---|---|
| 2,154,897 A * | 4/1939 | Grant | E04B 1/34815 52/236.1 |
| 3,395,502 A * | 8/1968 | Frey | E04B 1/3404 52/73 |
| 4,357,882 A | 11/1982 | Hiorth | |
| 8,006,600 B2 | 8/2011 | Fujiwara et al. | |
| 2002/0116879 A1 * | 8/2002 | Lindsley | E04H 1/02 52/79.1 |

(Continued)

FOREIGN PATENT DOCUMENTS

| | | |
|---|---|---|
| GB | 192074 B | 3/1958 |
| WO | 9923419 A1 | 5/1999 |

*Primary Examiner* — Jessica L Laux

(74) *Attorney, Agent, or Firm* — Berggren LLP

(57) ABSTRACT

Structure of a facility for demining, investigating and testing of an explosive device which comprises several structural elements connected to each other for processing an explosive device. The elements comprise a chamber for demining, investigation and testing, and for the initial suppression of the potential explosion shock wave and primary collection of the explosive residues, a chamber for secondary suppression and secondary collection of the explosion shock wave, a chamber for final suppression of the shock wave including filtration and the final collection of the explosive residue and the shock wave spreading space. The chambers have openings in front, where shock wave deflectors have been placed and behind the openings have been placed barrier walls. In the chamber walls and the ceiling have been placed cameras, lights, lighting tunnels and ventilation equipment. Between the chambers are automatic opening and closing doors, and the building is covered with a composite cover.

10 Claims, 5 Drawing Sheets

(56) References Cited

U.S. PATENT DOCUMENTS

| | | | | |
|---|---|---|---|---|
| 2005/0252100 | A1* | 11/2005 | Nord | E04H 1/02 52/79.4 |
| 2008/0289265 | A1* | 11/2008 | Lessard | E04H 1/005 52/79.1 |
| 2010/0212552 | A1* | 8/2010 | Stratton | C04B 28/02 106/712 |
| 2011/0173899 | A1* | 7/2011 | Lythgoe | E04B 1/04 52/79.4 |

* cited by examiner

STRUCTURE OF A FACILITY FOR DEMINING, INVESTIGATING AND TESTING OF AN EXPLOSIVE DEVICE

PRIORITY

This application claims priority of Estonian utility model application No. U201500087, filed on Dec. 31, 2015 the contents of which are fully incorporated herein by reference.

TECHNICAL AREA

This invention belongs to the field of construction for the provision of security, civil protection, forensic science, the fight against terrorism, the defense industry, de-mining and investigation of explosive devices and substances. More specifically, the invention relates to the plant design, which is intended for de-mining, investigation and testing of explosive devices (including the explosive devices unknown in terms of the composition, performance, and/or structure).

BACKGROUND

Known, for example, are a tubular-shaped reinforced concrete facility for mine clearance and investigation of explosive devices, of which the main drawback is the fact that when in the course of de-mining, the explosive device (including unknown) explodes in an uncontrolled way, it is not possible to collect the parts and pieces of the explosive device for investigative purposes, because they are scattered on a relatively large scale and mixed with other materials. In addition, the residual substances of the device (which may be radioactive, toxic and harmful to the environment in very different ways) scatter in a wide range of the territory, and as a result of the explosion, the surroundings will be vibrating heavily.

Known are also special capsules, detonation chambers and containers of a different design, whose disadvantage is the relatively small dimensions, and therefore, an explosive device of unknown composition with significant dimensions cannot be transported to the detonation chamber. Detonation chambers are only intended for the detonation of explosive devices, and therefore, it is not possible to demine and explore an unknown explosive device in them.

A known solution (WO9923419, MGC Plasma AG, Fuenfshilling Mathias R, et al., published May 14, 1999) relate to an explosion-proof reaction chamber for special safe storage of objects containing explosives and includes feeding devices and the openings for adding and removal of reaction products. The chamber floor is rotatable; the chamber comprises a table on which a large mass to be blasted will be placed.

A known facility for processing explosives (GB792074, Du Pont, published on Mar. 19, 1958) comprises sidewalls, an end wall, a roof with a ceiling dome to avoid transfer of detonation products (chips, etc.) into other buildings. The facility is equipped with ventilation shafts and tunnels for various purposes. The materials to be treated are inserted and removed by means of conveyor-tunnels, whereas each of the tunnels is made of concrete. The conveyors are separated from the treatment chamber with sparks blocking shield.

Known is the invention (JP4247373 B2, National Institute of Advanced Industrial Science, Kobe Steel, Ltd., published on Oct. 26, 2006), which handles a high-pressure container located inside a dome targeted for the detonation of an object to be treated. The container is made of steel and has a cover to withstand pressure shock, for example, of a chemical bomb. The container is hollow, open at one end, and is fitted horizontally. An explosive object is placed into the container and fastened with fastening devices. The container has several holes in the upper part for supplying the container with oxygen before the blasting, for insertion of air, water and detergent for deactivation after the explosion. On the top of the container, and opposite the cover on the side wall, are openings for creating the vacuum by pumping out air through the filter with a vacuum pump. At the bottom of the container is a drainage system, through which the waste water flows into a technological tank. Outside the container is an ignition device with a remote control possibility for the detonation of the explosive device. On the cover of the container is a door for insertion of an explosive device and an exhaust ventilation channel through which air is vented with the pump through a filter.

In terms of only a technical nature, the invention closest to the presented solution is (U.S. Pat. No. 4,357,882, Dyno Industrier A/S, published on Nov. 9, 1982), which comprises a facility for repeated detonation of an explosive and for analyzing the detonation results (the measurement of the blasting strength, i.e of the amount of energy generated, and the like). The facility comprises a tubular steel structure, which has two walls inside the tube and which define the detonation chamber in the central portion thereof. A wall with a profile beam is placed at least at one end of the tube, which together with a corresponding side wall forms one or two side chambers, which are filled with stones. A tube-shaped steel structure is positioned horizontally and freely on a bed of sand and covered with sand in the entire length. Due to its steel structure, its side chambers are filled with stones, and it is covered with sand, the facility efficiently mutes the sound and reduces the explosion pressure. The disadvantages of this solution are: the renowned facility is provided for and allows only the analysis of the blast results of explosives and explosive substances to a limited extent, in case of an explosion of an explosive device, it is not possible to gather the ingredients in a significant volume (more than 95%) for further investigation, including preservation of evidence is not secured, the shape of the detonation chamber is not rational for the adoption of the explosion energy; in addition, the realization of the entire facility significantly resources intensive in terms of the quantity of the substance to be blasted.

The design of the facility described in the invention overcomes these drawbacks and enables the explosive device (including an unknown one), and parts of it, to be examined and to demine the makeup of the explosive device. In order to carry out chemical, physical, fingerprints, DNA, etc. studies of its components, which provide information about the manufacturer, origin, implementation, manufacturing technology and construction and of the composition of the materials of the explosive device. In addition, in case of the construction of the facility for demining, investigation and testing of explosive devices (including the unknown), (i.e. in the occurrence of the possible explosion of the explosive device) it is also important to take into account the sound/blast with a negative impact, the dynamic shock wave of the blast residue and ground vibrations for the surrounding environment, which could result in destruction of the buildings and structures, or parts thereof, in the region, which is why there is a great need for free territory. The explosive device can also comprise harmful compounds/substances, such as radioactive elements, toxins, harmful bacteria, etc., which pollute significantly and dangerously the environment during demining and during the investigation, the location must be protected from radio waves, magnetic impact and random vibrations which are ensured in case of the disclosed solution.

SUMMARY OF THE INVENTION

For demining, investigation and testing of explosive devices (including the unknown) is prepared a facility with a special shape serving the technical function and with the structure of a composite material which on a sudden and uncontrollable explosion of an explosive device, receives the kinetic pressure energy of the dynamic blast of its residues and the shock of the pieces of the ingredients, the vibrations and dampens the sound, and which ensures the possibility of collection of the residual components of the explosion.

The facility, with the disclosed construction, is a multi-staged system of structural elements based on different technical features and fulfilling different technical functions with chambers/rooms.

The aim of the invention is:

- to make de-mining, research and testing of an explosive device safe (including to minimize the effects of an unforeseen explosion, such as mechanical destructive impact of the explosion residues, a loud sound and ground vibrations on the surrounding environment and to prevent the contamination of the surrounding environment with chemical, biological, radioactive and/or toxic substances);
- in addition, to ensure the preservation of evidence and to allow for more accurate and thorough examination of the composition of the explosive device and is parts, its components, and its structure, and, among other things in terms of the post-explosion residues;
- realization of demining, investigation and testing of an explosive device with optimum materials and energy resources;
- to simplify and make safer, the transport of an explosive device to the location or facility for demining, investigation and testing.

In addition, in case of the construction of the facility for demining, investigation and testing of explosive devices) including the unknown), i.e. in the occurrence of the possible explosion of the explosive device, it also important to take into account the sound/blast with a negative impact, the dynamic shock wave of the blast residue and ground vibrations for the surrounding environment, which could result in the destruction of other buildings and structures, or parts thereof, in the region, which is why there is a great need for free territory. The explosive device can also contain harmful compounds/substances, such as radioactive elements, toxins, harmful bacteria, etc., which pollute significantly and dangerously the environment and during demining and during investigation, the location must be protected from radio waves, magnetic impact and random vibrations for the avoidance of the dangerous impact factors of which is ensured in the case of the disclosed solution.

The structure of the facility building for demining, investigating and testing of an explosive device comprises several structural elements incrementally connected to each other for processing of the explosive device, said structure comprises: a chamber for de-mining, investigation and testing, and for the initial suppression of the explosion shock wave and primary collection of the explosive residues (Stage 1), a chamber for secondary suppression and secondary collection the explosion shock wave residues (Stage 2), a chamber for final suppression of the shock wave and filtration and the final collection of the explosion residue (Stage 3) and a shock wave spreading space (Stage 4). The chambers have openings, in front of which have been placed shock wave deflectors and behind the openings have been placed barrier walls, in the chamber walls, and the ceiling contains cameras, lights, lighting tunnels, ventilation equipment; between the chambers are automatically opening and closing doors, and the building is covered with a composite cover.

LIST OF FIGURES

EMBODIMENT OF THE INVENTION

Figure 1:
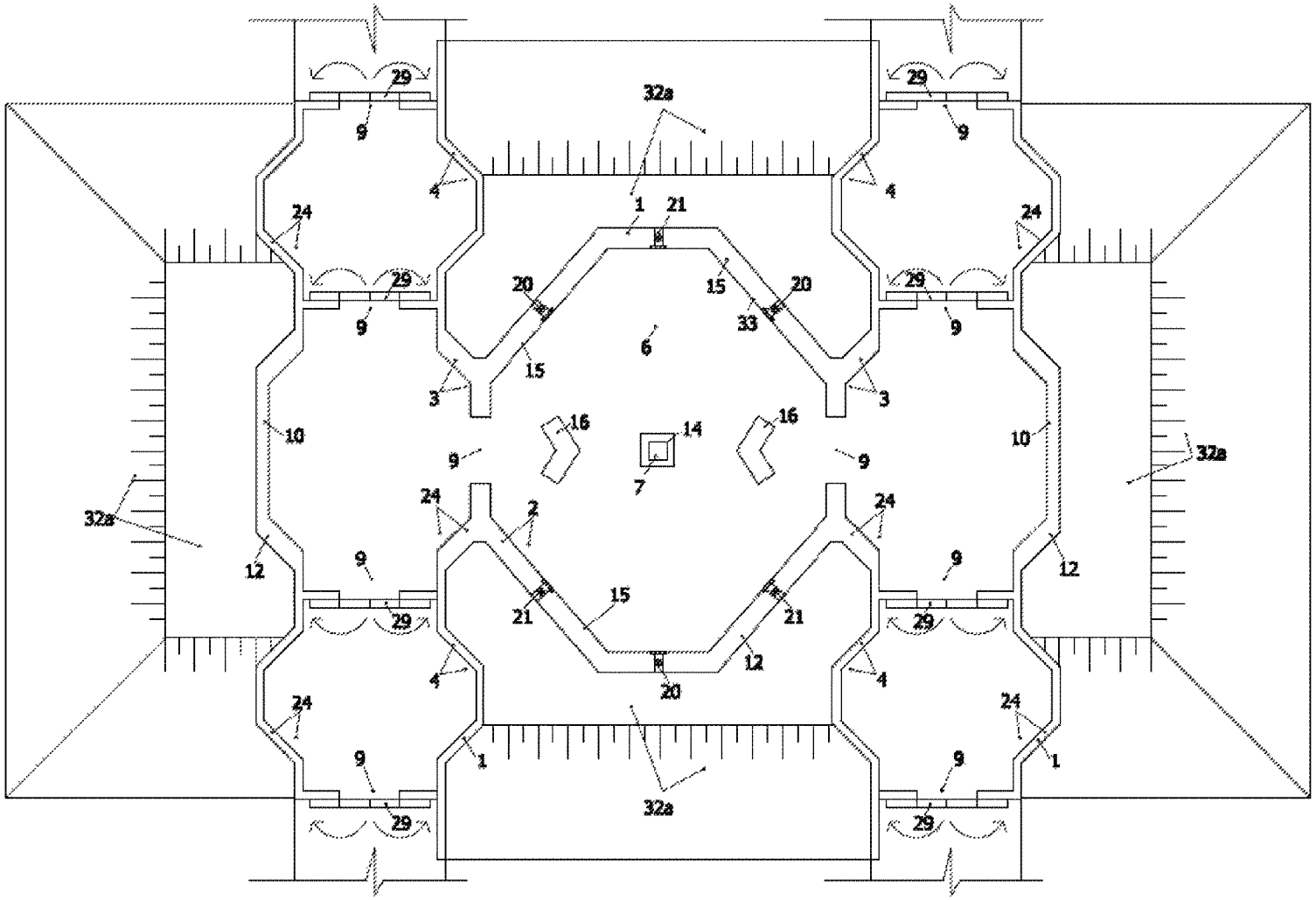
FIG. 1 shows a general view of the structure of the facility corresponding to the invention.
Figure 2:
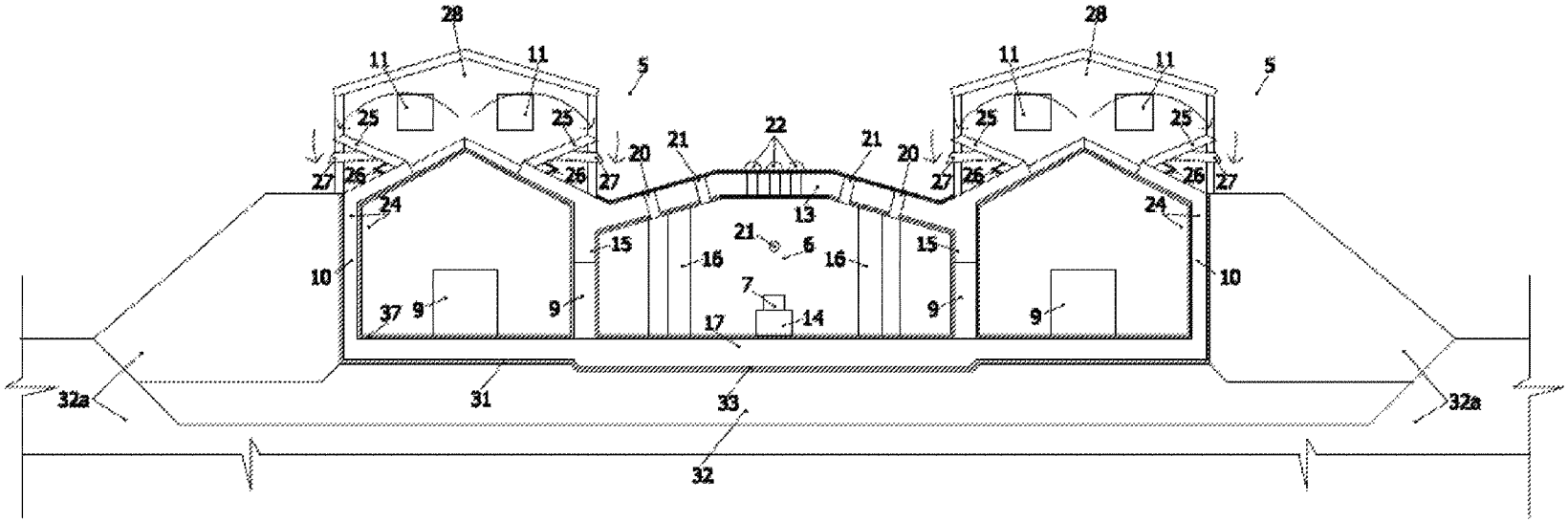
FIG. 2 shows a longitudinal section of the structure of the facility corresponding to the invention.
Figure 3:
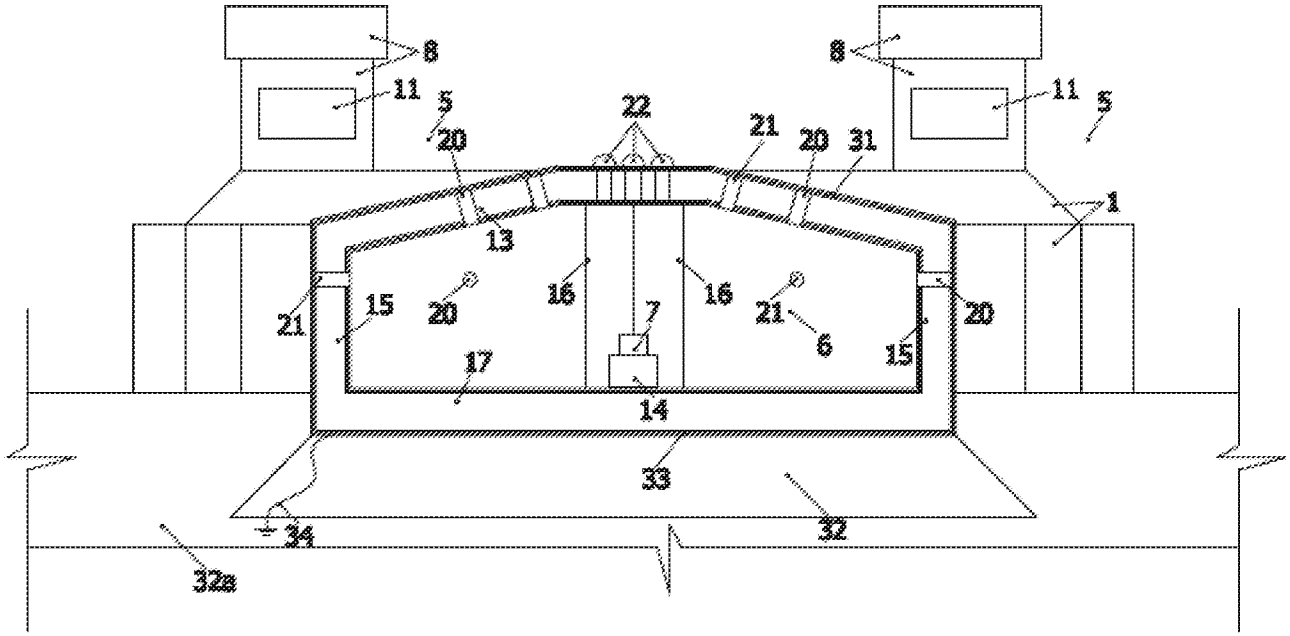
FIG. 3 shows a transverse section of the structure of the facility corresponding to the invention.
Figure 4:
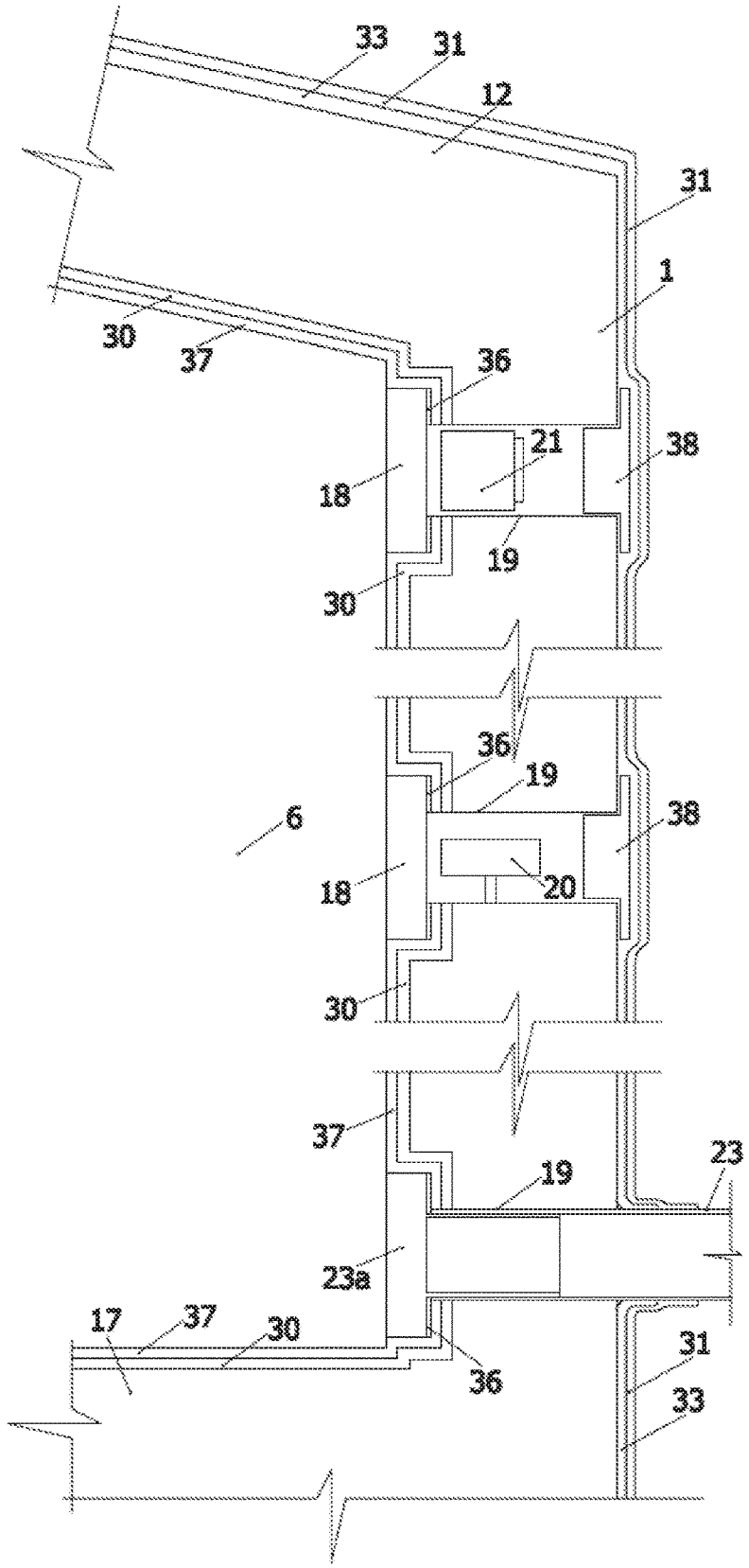
FIG. 4 shows the solution of the opening of the structure of the facility corresponding to the invention for the installation of the lighting, the camera and ventilation equipment.
Figure 5:
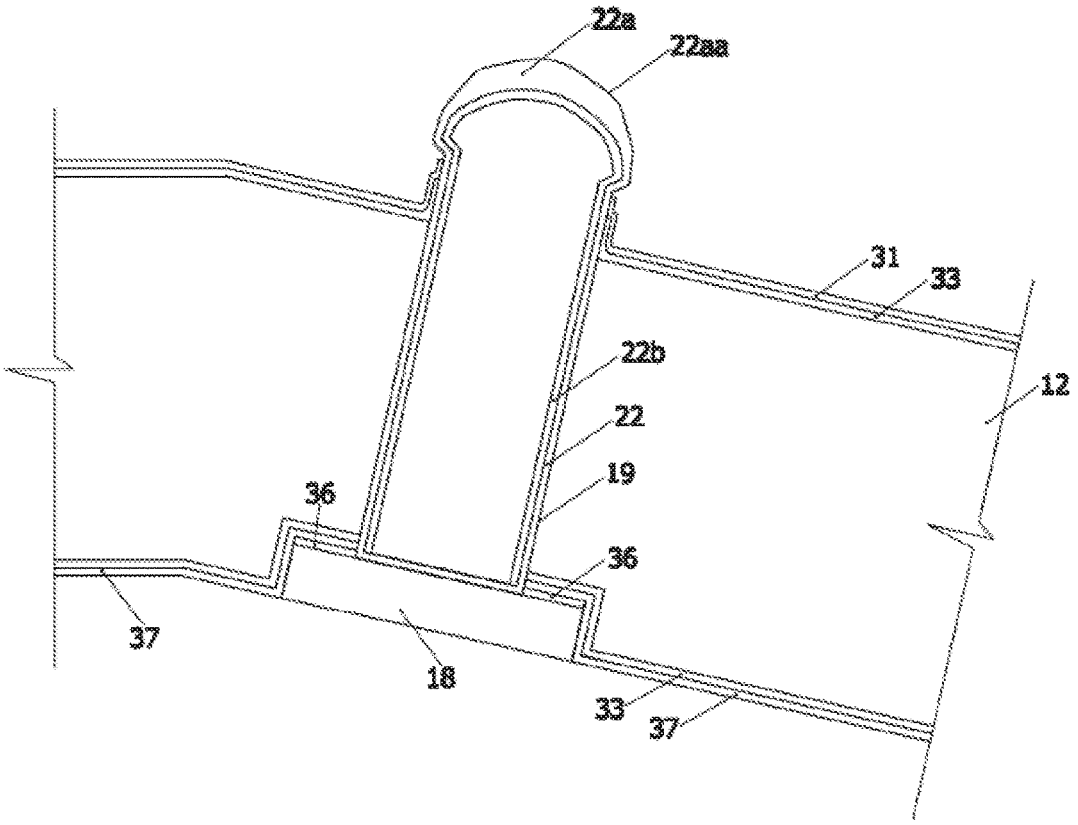
FIG. 5 shows the solution of the opening of the structure of the facility corresponding to the invention for the installation of the light tunnel.

The structure of the disclosed facility 1 comprises several systems of structural elements (chambers/rooms) incrementally connected to each other fulfilling different technical functions and comprising: a chamber 2 for de-mining, investigation and testing, and for the initial suppression of the explosion shock wave and primary collection of the explosive residues (Stage 1); a chamber 3 for secondary suppression and secondary collection the explosion shock wave residues (Stage 2); a chamber 4 for final suppression of the shock wave and filtration and the final collection of the explosion residue (Stage 3); a space 5 for dissipation of the shock wave or the external environment in close vicinity of the facility (Stage 4). The chamber 2 has openings 9 (a minimum of two openings), in front of which have been placed blast deflectors 16 and behind the openings 9 have been placed barrier walls 10, in the walls 15 and the ceiling 13 of the chamber 2 are attached cameras 20, lights 21, the lighting tunnels 22 for the natural light, i.e. the daylight, the end elements 23*a* of the supply pipes of the forced ventilation of the mechanical ventilation system 23. Between the chambers 3 and 4 and in front of the chamber 4 are elastically automatically opening and closing doors 29. The structure of the facility 1 is coated with waterproofing composite coating (31) and is located on the draining sand layer 32*a* that in its granulometric composition is fractioned.

The openings 9 of the chambers 2, 3, 4 are arranged perpendicularly (i.e non-parallel or oblique) against the direction of dynamic movement of flow of the blast residues/components 8, which is used for further quenching the dynamic speed and the pressure/impetus of the explosion components by way of causing the vortex of the explosion residues 8 and their impingement with one another. The kinetic energy of the explosion residues 8 is further suppressed by the barrier wall 10 of a horizontally and vertically concave shape, against which the explosion residue is targeted when being flung out of the openings 9 of the chamber 2. In front of the external openings 9 located above the chamber 4 (i.e. in front of the room 5) are placed filters 11, depending on the source of danger, whether for the capture of chemical, mechanical, biological, toxic or radioactive explosion residues/components 8 and to prevent their access to the free airspace surrounding the facility 1 or to the environment 5, i.e. into the Stage 4.

The chamber 2 (i.e. the room 6 located in the chamber 2) is carried out with a barrier 12 from the composite structure (for example, heavy concrete reinforced with mineral filling and steel reinforcement) of oval or oval-polygonal shape, the lengths of the lateral and longitudinal cross-sections are significantly different (e.g. more than 20%).

The ceiling 13 of the chamber 2, and of the room 6 located therein is in terms of its technical features arched or polygonal-arched in transverse directions, forming a transversally arched dome above the room 6. Such technical features help to ensure a relatively uniform distribution of the dynamic explosion pressure to the barriers 12 of the chamber 2, the limits of 12 and avoids concentration of stress in the corners of chamber 2, and the result of which the construction of the barrier of the room with optimal resources (i.e. the dimensions of the room depending on the maximum impact of the explosion energy on the barriers is optimal) is achieved, and the useful lifetime of the barriers is extended compared to the solutions known from the prior art.

Room 6 in terms of its technical features has curved obtuse angles or a curved barrier 12, ensuring an easy and maximum availability and collection of the explosion residues 8 for the purposes of the investigation and scattering the concentration of the pressures within the barriers 12 of the facility 1 boundaries 12 on demining, investigation and/or testing of the explosive device 7 upon its unexpected and uncontrolled explosion.

In the walls, 15 with the smaller spacing of sides of the chamber 2 have been built openings 9. The size of the openings 9 (i.e. width and height, for example, the optimum width of the opening 9 is 1.7 to 2.2 meters, and the height is 2.1 to 2.4 meters) is selected as the minimum so that it would be possible to transport the explosive device 7 with the expected maximum size into the chamber 2 and to place it onto the worktable/work-base 14 (i.e. on a solid base) remotely (from a safe distance or location) with a remote-controlled robot. The wall surface in front and behind the openings 9 is carried out considerably larger in comparison with the surface of the opening 9 (i.e. symmetrically wider, a minimum of two times the width of the opening and higher, a minimum of 1.5 times the height of the opening), and the opening 9 is located horizontally in the middle of the wall surface and vertically in the lower part of the wall. Such a solution generates sharp attenuation of the kinetic energy of the dynamic movement of the explosion residues/components 8, by way of creating a vortex behind the opening 9.

On the front of the openings 9 of the chamber 2 from the floor-to-ceiling are placed shockwave deflectors 16 that in the case of an explosion of the explosive device, dampen the shock wave and direct the pieces/residues/components 8 of the explosive device and the gases away from the opening 9.

Horizontally, the cross-section of the shock wave reflectors 16 have an arrow shape, the direction of the end of the cross-section is in the direction of the middle of the chamber 2 towards the work table/work base 14. Shockwave deflectors 16 are installed forward from the wall of the room 6 by a minimum of 1.1 times of the width of the opening, and they are located horizontally and symmetrical to the openings.

The explosive device 7 is placed in the middle of the room 6 of the chamber 2 above the substrate (or the floor 17) by heights of the work table 14 (for example, approximately 0.8 to 1.2 meters high) on a solid worktable/work-base 14 (which is made of an inert material, for example, a base of uncompressed mineral sand or a ceramic base board surrounded by a reinforced concrete cylinder) or it is hung by suspended dowels above the floor per one worktable/work-base height.

The explosive device 7 is mounted higher above the floor 17 in order to reduce and disperse the shock pressure and the shock strength of the explosion aggregated in one direction (i.e. towards the floor), i.e. providing the scattering of the shock strength/explosion strength in all directions and avoiding the concentration and the impact of the explosion pressure in the same direction.

The floor surface 17 of the room 6 is inclined in the direction of the openings 9 with the minimum of two pro mille incline, ensuring the flow of the washing agents and disinfectant substances and liquids out of the room 6.

In the ceiling 13 and the walls 15 of the room 6 of the chamber 2 in the facility 1 barrier 12 into the tubular openings 19 penetrating the barrier, are hermetically sealed, e.g. hermetically attached with a heat-resistant adhesive, a sealant or gasket 36, e.g. epoxide resin adhesive, and equipped with fasteners, for example, a minimum of three inert material threaded bolts, for example, stainless steel, fitted behind an impact-resistant and pressure resistant (bullet-proof) circular glass, 18 e.g. bullet-proof, 48 mm thick glass with a type designation BR4-NS, cameras 20 for visual monitoring and recording of the demining, investigation and testing process of the explosive device 7, lights 21 for artificial light, lighting tunnels 22 for entrance of natural daylight, and the end component 23*a* of the forced ventilation supply tube, coated analogously with a bullet-proof ceramic openable cover equipped with a hermetic seal and connected to the tubular pit 19 in the barrier 12 of the facility 1 for fast ventilation of chamber 12 by pushing in fresh/clean air. In from of the external opening of the light tunnels 22 is a glass dome 22*a* coated on the inside with a mirror surface and the light tunnels 22 are coated on the inside with a reflective inner surface 22*b*, as a result of which the light reaches from the outer surface 22*c* of the glass dome 22*a* of the light tunnel 22*a* glass dome 22*a* into the interior without loss, and with a several times higher intensity (i.e. from a significantly larger outer surface 22*c* of the glass dome 22*a* of the light tunnel 22 the light falling on the surface of the dome is mirrored into the light tunnel in an aggregate way) compared to the transverse luminous flux passing through the surface of the cross section of the light tunnel, i.e. if the light tunnel were covered by only a planar glass without a reflective inner surface and without a reflective dome aggregating the light. With such a solution of light, tunnels are achieved intense illumination of the room 6 of the chamber 2 with the natural light in the case of light openings with a relatively small surface (i.e. the surface of the light openings is minimized).

In front of the opening 9 of the chamber 2 (i.e. also the room 6) outside the chamber 2 are placed shock wave scattering and attenuation chambers 24, which are designed in such a way that next to and above the opening 9 of the stage 1 opens a significantly greater free space for scattering of explosion residues, including explosion gas 8, for emerging of vortexes and thus for essential and dramatic reduction and attenuation of the dynamic velocity of the gases as the result of creating vortexes of explosion residues.

Opposite the openings 9 of the chamber 2 (i.e. also the room 6) outside the chamber 2, are located barrier walls 10 absorbing the kinetic energy of the shock wave and directing it with a ricochet predominantly at 180 degrees, which have a curved or arcuate polygon shape on the vertical and horizontal planes.

Between the chamber 3 (Stage 2), and the chamber 4 (Stage 3) have been placed the openings 9 similar to those between the chamber 2 and chamber 3. Additionally, between the chamber 3 and the chamber 4 have been placed doors 29 that open elastically and automatically on the impact of the pressure of the explosion, which fulfills the function of deletion of the kinetic energy of the explosion pressure.

The shock wave scattering and attenuation chambers 24 of the chamber 4 have a polygonal shape, and they are equipped with hatches 25 elastically openable on the impact of the pressure of the explosion that is located in the ceiling in the traverse direction from the openings. Hatches 25 are hermetically closed, and they open/close with automatic closing devices 26, the closing strength of which is adjustable according to the maximum thrust of the anticipated aerodynamic shock. In the hatches are located positive pressure valves 27 which will automatically open (they open depending on the size of the impact of the trust of the explosion residues) elastically at the lower pressure than the hatches 25 themselves. Such cooperation of the system of positive pressure valves 27 and hatches 25 is to avoid a sudden dynamic shock and to ensure a smooth entrance of the explosion residues/gasses to the filter chambers 28, which are located above the hatches 25. The filter chamber 28 are located, as appropriate, filters 11 for capturing chemical, biological, mechanical, toxic and radioactive residual components 8 and prevention thereof from the release into the external environment.

In front of the chambers 3 and the chambers 4, i.e. the scattering and attenuation chambers 24 are placed hermetical and pressure resistant doors 29 that open and close automatically and elastically, through which the explosive device 7 is transported with the help of a remote-controlled robot to room 6 of chamber 2. The doors of the chambers 4 are hermetically and pressure resultantly closed during the demining, investigation and testing of an explosive device. In case of an explosive device explosion that is accidental or carried out for experimental purposes, the positive pressure 27 and the hatches 25 located in the ceiling of the chamber 4 open elastically on the impact of the dynamic pressure of the explosion residues and the explosive residues are directed to the filter chamber 28 and from there further to the filters 11, through which the purified gas (i.e. air) reaches the external environment in which it is dispersed.

Behind the filter chamber 28 of the chamber 4 is located the external environment of the facility, i.e. the space 5 of the final dispersion of the explosion shock (Stage 4), wherein the pressure of the explosion is finally dissipated in the close area/environment of the facility 1, in which the pressure of the residual gases of the explosion finally dissipates in the space 5 expanding to a substantial extent.

The interior surfaces of the structure of the facility 1 are covered with a special concrete hardener, with the help of which is obtained a high-strength and impact-resistant layer 30 to the inner surface of the facility, and it ensures the high impact resistance of the surface of the barrier 12 in case of the dynamic impact of the pieces or parts of the explosive device 7.

In the final order, the high-strength impact resistant layer 30 of the interior surface of the structure of the facility 1 is painted with the mineral binder paint 37 (e.g. whitewash or silicate paint) to be matte white, thereby ensuring the amplification of lighting and more even distribution of light and its homogeneous post-reflection from the surfaces in the room 6 (whereas the albedo value is ensured above 80%, i.e. more than 80% of the radiation energy of the light falling onto the inner surface of the room is reflected back into room 6 of chamber 2). With a whitewash or a silicate paint it is easy (i.e. with a minimum of resources) to restore the original condition of the internal surfaces of the structure of the facility 1 after the damage to the barrier surface (i.e. high strength and impact resistant layer 30) and surface color changes caused by a possible explosion of the explosive device 7.

The structure of the facility 1 is covered with a weather-resistant and waterproofing composite coating 31 (such as adhesive SBS (styrene butadiene styrene) coating, which comprises a reinforced nonwoven polyester support fabric, modified bitumen compounds material and the UV protective layer, such as loose slate. The tubular openings 19 penetrating the barrier 12 of the facility are covered with a special shutter 38, and the shutters are also covered by a weather-resistant and waterproofing composite cover 31.

The structure of the facility 1 is mounted on the mineral fine grain layer of soil 32 of one fractioned particle composition of draining sandy soil 32 (e.g with a filtration coefficient over two meters a day) and the groundwater level has been taken below the facility 1 by minimum the height of the capillary rise of the groundwater of the sandy soils 32*a*. The draining soil layer 32 has a thickness greater than the height of the capillary rise of the groundwater of the one fractioned particle composition of sandy soils 32*a*.

With the one fractioned particle composition sandy soils 32*a* of the draining, soil layer 32 is achieved efficient attenuation of the vibration caused by the explosion of the explosive device 7. This is because, in case of one fractioned particle composition sandy soils 32*a*, the contact surface of the grains of sand is minimal, and they can move much more freely and elastically (i.e. at the expense of voids between the grains of sand, and the vibration energy is transmitted elastically from one grain of sand to several grains of sand, i.e. the energy is attenuated). This is as compared to the different fractioned particle size composition of sandy soil, where smaller sand grains fill the intergranular voids of larger grains of sand and form a relatively monolithic environment (as compared to the draining soil layer 32 one fractioned particle composition sandy soils 32*a*, where the vibration spreads relatively well (i.e. the kinetic energy is transmitted from the source of vibration primarily in one direction, and this does not, therefore, absorb significantly).

Between the weather-resistant and waterproofing cover 31 of the facility 1, has been placed radiation, radio waves, sound and heat insulating and vibration-absorbing composite material 33 (for example, aluminum foil, polyethylene with sealed air acuities, aluminum foil, polyethylene foam, aluminum foil, a composite material consisting of layers of polyethylene with sealed air acuities and aluminum foil).

The aluminum foil layers of the composite material 33 and the metal parts of the facility 1 (including the steel reinforcement of the reinforced concrete barrier) are grounded with grounding 34, suspending the propagation of radio waves and electromagnetic impact on the explosive devices 7 and outside of it and the emergence of the difference between the static electric potentials inside the structure of facility 1, which can be a reason for the explosion of the explosive device 7, and a confounding factor of demining operations and investigation and testing work.

In the example of carrying out the invention and the constructive solution has been used an explosive device 7 unknown in terms of its composition, execution, and structure comprising an explosive in an amount of up to 200 kg RDX (which corresponds to approximately 300 kg of explosive TNT (trinitrotoluene)). Depending on the expected maximum amount of explosive and on the explosive capacity of the explosive devices subject to demining, investigation and/testing, the specific dimensions of the facility and the numerical values of the parameters are determined.

For quick absorption of the explosion pressure and for limiting of the projection area of the explosion residues, the number of structural elements (chambers/rooms) has been increased in different stages 1, 2, 4 times (i.e. in Stage 1 one chamber, in Stage 2 two chambers, in Stage 3 four chambers) starting from the first stage—from the chamber/room of demining, testing and investigation until the last stage of dissipation (for example, in Stage 3, four chambers). The number of chambers/rooms of the absorption and collection of explosion residues depends on the size of the possible explosion pressure, on the pressure resistance of the facility 1 and on the existence and size of the free room 5, i.e. the environment of dissipation of the shock wave around the facility 1.

The structure of the facility 1 works functionally as follows: in the chamber 2, the explosive device 7 is demined, examined and/or tested, and in case of a random explosion or an explosion for experimental purposes, the stream of the residual components 8 of the explosion burst is first suppressed and then it (i.e. the residual components 8 of the explosion of the explosive device 7) is directed to chamber 3, and if the explosive force is so large (depending on the explosive power of the explosive device) that it puts even more significant pressure on the barriers 12 of the chamber 3 of the facility, the shock wave of the explosion residues 8 will be directed to the chamber 4, and having passed through the chamber 4 and the filters 11, the positive pressure of the explosion residues is permanently dispersed in the dispersion environment 5 surrounding the facility 1 of the positive pressure of explosion residues. The residual components 8 captured in the chambers/rooms 2, 6, 3, 4, are collected for the purposes of their investigation and subsequent recycling.

According to one embodiment a structure of the facility 1 is disclosed for demining, investigation and testing of an explosive device comprising structural elements for processing (demining-blasting) of an explosive device, a barrier wall with openings, filter chambers, shock wave deflectors, access doors, ventilation equipment, coating of the facility, characterized in that the structure of the facility 1 comprises multiple-stage interconnected structural elements with a different function for processing the explosive device, comprising of:

- room (6) for demining, investigation and testing of the explosive device (7) and the chamber (2) for the primary suppression of the shock wave of the blast and the primary collection of the explosion residues—Stage 1;
- chamber (3) for the post-suppression of the shock wave of the blast and the post-collection of the explosion residues—Stage 2;
- chamber (4) for the final suppression of the shock-wave and the filtration and final collection of the explosion residues—Stage 3; and
- room (5) for shock wave dispersion—Stage 4;

and wherein

- chambers (2, 3 and 4) have openings (9) and behind the openings (9) have been placed barrier walls (10);
- in front of the openings (9) of the chamber (2) has been placed a shock wave deflector (16);
- in front of the external openings of the chamber (4) have been placed filters (11);
- in the ceiling and in the walls of the room (6) have been placed cameras (20), lights (21), light tunnels (22), the end elements (23*a*) of the supply tubes of the forced ventilation of the mechanical ventilation system (23);
- between the chamber (3) and the chamber (4) and in front of the chamber (3) and the chamber (4) have been placed automatically and elastically opening and closing doors (29), whereas the doors in front of the chamber (4) and opening from the facility to the external environment are hermetically, and pressure-resistant closed at the time of the demining, investigation, and testing of the explosive device;
- the inner surface of the structure of the facility (1) is covered with an impact resistant layer (30), wherein the inner surface of the structure of the facility (1) is matte white and with the albedo value of greater than 80%;
- the structure of the facility (1) is placed on mineral, one-fractional, fine-grained and drained soil layer (32);
- the facility (1) is coated with water resistant composite coating (31), between the coating (31) and the barrier (12) of the facility is placed a composite material (33) composed of radiation and sound-insulating and vibration-absorbing layers, wherein the aluminum foil layers of the composite material (33) and the metal parts of the structure of the facility are grounded with a grounding (34).

According to one embodiment the structure of the facility is characterized in that

- openings (9) are arranged perpendicularly to the direction of dynamic movement of the explosion stream;
- the wall surface surrounding the openings is symmetrically and to a minimum of 2 times larger than the width of the opening and a minimum of 1.5 times higher than the height of the opening;
- in front of the openings of the chambers (2) and (3) have been placed the shock wave suppression and cancelation chambers (24), which have a polygonal shape;
- the chambers (4) are provided with hatches (25) located in the ceiling transversally from the openings, opening/closing with elastically automatic latches (26) on the impact of the pressure force of the explosion, above the hatches have been positioned filter chambers (28) and the hatches (25) are provided with positive pressure valves (27) automatically and elastically openable on the impact of the pressure force;
- the size of the width and the height of the openings is the minimum in the size of the transportation of the expected maximum size explosive device with a remotely controlled robot into the room (6) of the chamber (2).

According to one embodiment the structure of the facility (1) is characterized in that by the fact that the barrier walls (10) are horizontally and vertically of an arcuate or polygonal, arcuate shape.

According to one embodiment the structure of the facility (1) is characterized in that by the fact that the shock wave deflectors (16) are in the horizontal cross-section of an arrow shape, in which the direction of the tip of the cross-section is to the middle of the chamber (2) in the direction of the table of investigation-demining-testing table (14) of the explosive device, and the shock wave deflectors have been installed forward from the wall of the demining-investigation-testing chamber by the minimum of 1.1 times the width of the opening.

According to one embodiment the structure of the facility (1) is characterized in that the chamber/room (2, 6) have an oval or oval-polygonal shaped composite structure barrier (12), wherein the lengths of its lateral and longitudinal cross-section differ more than 20%;

the ceiling (13) of the room (6) arcuate or polygonally arcuate and forms a transversally arcuate dome above the chamber (6);

the floor surface of the chamber (2) is inclined in the direction of the openings (9) with the minimum of two pro mille incline.

According to one embodiment the structure of the facility 1 is characterized in that the waterproofing composite coating (31) of the facility comprises a reinforced nonwoven polyester support fabric, a modified material of bitumen composites and a UV protection layer.

According to one embodiment the structure of the facility (1) is characterized in that the radiation and sound insulating and vibration suppressing composite material placed between the coating of the facility and the barrier of the facility is layered and comprises the layers of aluminum foil, polyethylene with closed air vacuities, aluminum foil, polyethylene foam, aluminum foil, polyethylene with closed air vacuities and aluminum foil.

According to one embodiment the structure of the facility (1) is characterized in that the shock wave dispersion room (5) is the external environment in the close vicinity of the facility (1).

According to one embodiment the structure of the facility (1) is characterized in that for the purpose of speeding up the suppression of the explosion pressure, the number of chambers in different stages has been increased in each stage.

According to one embodiment the structure of the facility (1) is characterized in that the cameras (20), lights (21), light tunnels (22) and the end elements (23*a*) of the supply air pipes of the forced ventilation of the mechanical ventilation system (23) are placed in the openings with a circular cross-section, penetrating the barrier of the facility established within the barriers (12), wherein the openings are covered from the inside by a barrier of the facility with impact-resistant glass, which is hermetically sealed with a heat resistant gasket.

| List of denotations | |
|---|---|
| 1 | Facility for demining, investigating and testing of explosive devices |
| 2 | Chamber for primary suppression of the shock wave and primary collection and demining, investigation, testing of explosion residues (Stage 1) |
| 3 | Chamber of post-suppression of the shock-wave and the post-collection of the explosion residues (Stage 2) |
| 4 | Chamber for final suppression of the shock-wave and the filtration and final collection of the explosion residues (Stage 3) |
| 5 | Shockwave dispersion room (Stage 4) |
| 6 | Room 6 of the chamber 2 for demining, investigation and testing of the explosive device 7 |
| 7 | Explosive devices (including unknown devices) |
| 8 | Explosion residues/components |
| 9 | Openings of the chambers |
| 10 | Barrier wall |
| 11 | Filters |
| 12 | The barrier of the facility 2 |
| 13 | Ceiling of the room 6 |
| 14 | Work table/workbase |
| 15 | Walls of room 6 |
| 16 | Shockwave deflectors |
| 17 | Floor |
| 18 | Stroke and pressure resistant (bulletproof) glass |

-continued

| List of denotations | |
|---|---|
| 19 | Tubular opening penetrating the barrier 12 of the facility 1 |
| 20 | Camera |
| 21 | Lighting |
| 22 | Light tunnel |
| 22a | Glass dome of the light tunnel |
| 22b | Reflective inner surface of the light tunnel |
| 22c | External surface of the glass dome of the light tunnel |
| 23 | Mechanical ventilation system |
| 23a | End element of the forced ventilation supply tube |
| 24 | Scattering and attenuation chamber of a shock wave |
| 25 | Hatches |
| 26 | Latches |
| 27 | Positive pressure valves |
| 28 | Filter chamber |
| 29 | Automatically and flexible opening and closing doors |
| 30 | Impact-resistant layer |
| 31 | Waterproofing composite coating |
| 32 | Draining soil layer |
| 32a | One fractioned particle composition sandy soil |
| 33 | Composite material |
| 34 | Grounding |
| 35 | Integrated system of the chambers 2, 3, 4 of difference technical function |
| 36 | Heat-resistant adhesive or a heat-resistant sealant or gasket |
| 37 | White paint with mineral binders (albedo value of more than 80%) |
| 38 | latch of the tubular opening 19 in the barrier 12 of the facility 1 |

The invention claimed is:

1. A structure of a facility for demining, investigation and testing of an explosive device, said structure comprising:

multiple-stage interconnected structural elements with different functions for processing the explosive device; comprising:

a room for demining, investigating and testing of the explosive device and a chamber for primary suppression of shock wave of a blast and a primary collection of the explosion residues, a chamber for post-suppression of the shock wave of the blast and a post-collection of the explosion residues, a chamber for final suppression of the shock wave and filtration and final collection of the explosion residues;

a room for shock wave dispersion, wherein the chambers have openings and behind the openings have been placed barrier walls;

shock wave deflectors are located in front of the openings of the chamber for primary suppression wherein a cross-section of shock wave deflectors has an arrow shape and wherein a direction of the arrow shape is in a direction of the middle of the chamber;

filters are located in front of the openings of the chamber for final suppression;

in a ceiling and in walls of the room for demining, investigation and testing of the explosive device have been placed cameras, lights, light tunnels, end elements of supply tubes of forced ventilation of a mechanical ventilation system; and between the chamber for post-suppression and the chamber for final suppression and in front of the chamber for post-suppression and the chamber for final suppression have been placed automatically and elastically opening and closing doors, wherein the doors in front of the chamber for final suppression and opening from the facility to external environment are hermetically, and pressure-resistant closed at the time of the demining, investigation, and testing of the explosive device; an inner surface of the structure of the facility is covered with an impact resistant layer, wherein the inner surface of the structure of the facility is matte white and with albedo value of greater than 80%, the structure of the facility is placed on mineral, one-fractional, fine-grained and drained soil layer, the facility is coated with water resistant composite coating, between the coating and the barrier walls is placed a composite material composed of radiation and sound-insulating and vibration-absorbing layers, wherein the material includes aluminium foil layers, wherein the aluminium foil layers of the composite material and one or more metal parts of the structure of the facility are grounded with a grounding, wherein the cameras, lights, light tunnels and the end elements of the supply air pipes of the forced ventilation of the mechanical ventilation system are placed in an openings with a circular cross-section, penetrating the barrier walls established within the structure of the facility, and wherein the openings are covered from the inside by a barrier of the facility with impact-resistant glass, which is hermetically sealed with a heat resistant gasket.

2. The structure of the facility according to claim 1, wherein the openings of the chamber for primary suppression are arranged parallel to an explosive device; wall surface surrounding the openings is symmetrically and to a minimum of 2 times larger than width of the openings and a minimum of 1.5 times higher than height of the openings; the chambers for the post-suppression are provided behind the openings of the chamber for the primary suppression, wherein the chambers for the post-suppression have a polygonal shape; the chambers for final suppression are provided with hatches located in a ceiling transversally from openings between the chamber for the post-suppression and the chamber for the final suppression, opening and closing with elastically automatic latches on impact of pressure force of the explosion, above the hatches have been positioned filter chambers and the hatches are provided with positive pressure valves automatically and elastically openable on the impact of the pressure force; a size of a width and a height of the openings between the chamber for the post-suppression and the chamber for the final suppression is determined for a remotely controlled robot to go into the room for demining, investigation and testing of the explosive device of the chamber for primary suppression.

3. The structure of the facility according to claim 1, wherein the barrier walls are horizontally and vertically of an arcuate or polygonal, arcuate shape.

4. The structure of the facility according to claim 1, wherein the shock wave deflectors are in horizontal cross-section of the arrow shape, in which direction of tip of cross-section is to the middle of the chamber for primary suppression in direction of a table of investigation-demining-testing table of the explosive device, and the shock wave deflectors have been installed forward from the wall of the demining-investigation-testing chamber by a minimum of 1.1 times the width of the opening.

5. The structure of the facility according to claim 1, wherein the chamber for the primary suppression or the room for demining, investigation and testing of the explosive device or both have an oval or oval-polygonal shaped composite structure barrier, wherein lengths of its lateral and longitudinal cross-section differ more than 20%; the ceiling of the room for demining, investigation and testing of the explosive device forms a transversally arcuate dome above the room for demining, investigation and testing of the explosive device; a floor surface of the chamber for primary suppression is inclined in direction of the openings.

6. The structure of the facility according to claim 1, wherein a waterproofing composite coating of the facility comprises a reinforced nonwoven polyester support fabric, a modified material of bitumen composites and a UV protection layer.

7. The structure of the facility according to claim 1, wherein the radiation and sound insulating and vibration suppressing composite material placed between the water resistant composite coating of the facility and the barrier walls is layered and comprises layers of aluminium foil, polyethylene with closed air vacuities, aluminium foil, polyethylene foam, aluminium foil, polyethylene with closed air vacuities and aluminium foil.

8. The structure of the facility according to claim 1, wherein the number of the chambers is adjustable.

9. The structure of the facility according to claim 1, wherein the shock wave dispersion room is an external environment in the structure of the facility.

10. A structure of a facility for demining, investigation and testing of an explosive device, said structure comprising:

multiple-stage interconnected structural elements with different functions for processing the explosive device; comprising:

a room for demining, investigating and testing of the explosive device and a chamber for primary suppression of shock wave of a blast and a primary collection of the explosion residues, a chamber for post-suppression of the shock wave of the blast and a post-collection of the explosion residues, a chamber for final suppression of the shock wave and filtration and final collection of the explosion residues;

a room for shock wave dispersion, wherein the chambers have openings and behind the openings have been placed barrier walls;

shock wave deflectors are located in front of the openings of the chamber for primary suppression;

filters are located in front of the openings of the chamber for final suppression;

in a ceiling and in walls of the room for demining, investigation and testing of the explosive device have been placed cameras, lights, light tunnels, end elements of supply tubes of forced ventilation of a mechanical ventilation system; and between the chamber for post-suppression and the chamber for final suppression and in front of the chamber for post-suppression and the chamber for final suppression have been placed automatically and elastically opening and closing doors, wherein the doors in front of the chamber for final suppression and opening from the facility to external environment are hermetically, and pressure-resistant closed at the time of the demining, investigation, and testing of the explosive device; an inner surface of the structure of the facility is covered with an impact resistant layer, wherein the inner surface of the structure of the facility is matte white and with albedo value of greater than 80%, the structure of the facility is placed on mineral, one-fractional, fine-grained and drained soil layer, the facility is coated with water resistant composite coating, between the coating and the barrier walls is placed a composite material composed of radiation and sound-insulating and vibration-absorbing layers, wherein the material includes aluminium foil layers, wherein the aluminium foil layers of the composite material and one or more metal parts of the structure of the facility are grounded with a grounding, and wherein the radiation and sound insulating and vibration suppressing composite material placed between the water resistant composite coating of the facility and the barrier walls is layered and comprises layers of aluminium foil, polyethylene with closed air vacuities, aluminium foil, polyethylene foam, aluminium foil, polyethylene with closed air vacuities and aluminium foil.

* * * * *